United States Patent [19]

Craig

[11] 4,397,492

[45] * Aug. 9, 1983

[54] ROOF TRUSS SUSPENSION

[76] Inventor: William R. Craig, Rte. 286, Monroeville, Pa. 15146

[ * ] Notice: The portion of the term of this patent subsequent to May 26, 1998, has been disclaimed.

[21] Appl. No.: 296,641

[22] Filed: Aug. 27, 1981

[51] Int. Cl.[3] ..... B66C 1/14

[52] U.S. Cl. ..... 294/81 R; 294/87 R

[58] Field of Search ..... 294/26, 67 R, 67 DA, 294/67 DB, 67 E, 65, 65.5, 78 R, 81 R, 81 SF, 82 R, 87 R, 92; 52/122, 125; 414/10-12

[56] References Cited

U.S. PATENT DOCUMENTS

| | | | |
|---|---|---|---|
| 1,007,663 | 11/1911 | Atterbury | 294/81 R X |
| 1,047,954 | 12/1912 | Krohne | 294/65.5 |
| 1,291,437 | 1/1919 | Desch | 294/81 R |
| 1,762,271 | 6/1930 | Hutchings | 294/67 DA |
| 1,846,038 | 2/1932 | Owens | 294/67 DA |
| 1,970,617 | 8/1934 | Morgan | 294/74 X |
| 2,472,500 | 6/1949 | Swanson | 294/92 |
| 4,269,442 | 5/1981 | Craig | 294/81 R |

FOREIGN PATENT DOCUMENTS

| | | | |
|---|---|---|---|
| 211901 | 6/1956 | Australia | 294/81 R |
| 617563 | 7/1978 | U.S.S.R. | 294/81 R |

*Primary Examiner*—Johnny D. Cherry

*Attorney, Agent, or Firm*—William J. Ruano

[57] ABSTRACT

A suspension or rig for simultaneously setting a plurality of roof trusses on a building framing. A plurality of spaced vertical cables are suspended from a pair of horizontally extending pipes and connected to a central portion of each top sloping side of each truss, making two suspensions for each truss. A pair of horizontally extending spaced parallel pipes have ends connected to the pair of pipes. Suspending apparatus lifted by a crane comprises four linkage elements connected to end portions of the last mentioned pair of horizontally extending spaced parallel pipes. The improvement comprises securely fastening each truss at a predetermined distance from its apex to assure a perfectly horizontal and co-planer base for all the trusses, also the addition of eyes near the base portion of the trusses, through which eyes a cable or rope is passed together with flexible cable or rope portions for holding the trusses securely together equi-distantly and in spaced parallel relationship.

2 Claims, 5 Drawing Figures

ROOF TRUSS SUSPENSION

This invention relates to a lifting support frame for setting trusses by means of a crane. It is an improvement over that described in my U.S. Pat. No. 4,269,442 issued May 26, 1981.

In the past, great difficulty has been experienced in erecting and setting trusses, such as those for supporting roof structures of buildings and the like. The structure had to be assembled at the site of the building by lifting and setting in place one truss at a time involving considerable time and expense for erection—also involving considerable danger of falling—particularly the first truss installed.

While the structure shown in my patent is a considerable improvement over existing structures, it has the disadvantage of having trusses easily moved out of parallel relationship, particularly when subjected to heavy winds in which case one truss, upon contacting an adjacent truss, will soon cause all of the trusses to move out of parallel relationship thereby causing difficulty in properly setting the trusses on top of the building framework.

An object of the present invention is to overcome the above-named disadvantages by means of a special rig or lifting support frame which is lifted by a crane for suspending and lifting a prefabricated or completely assembled roof truss at the construction site.

Figure 1:
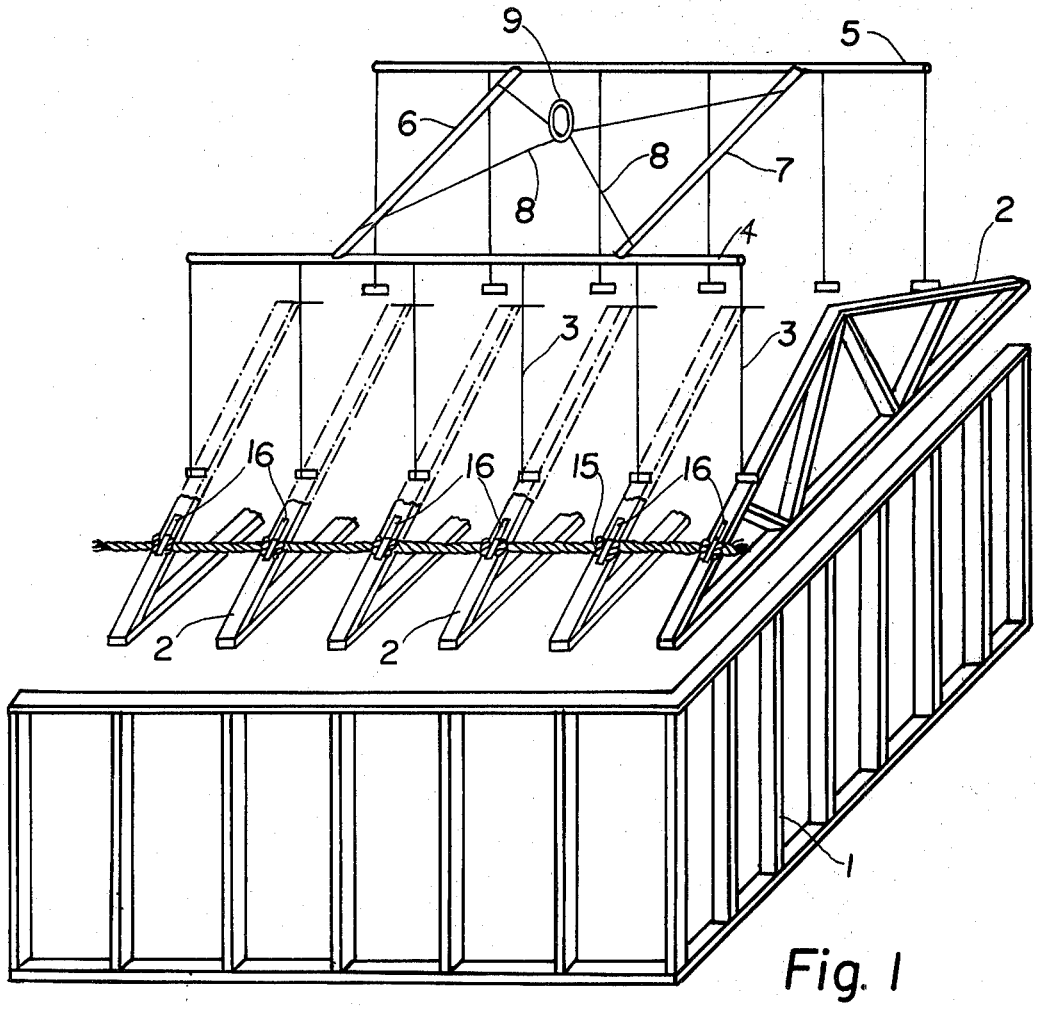
Figure 2:
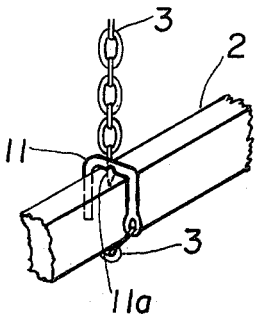
Figure 2A:
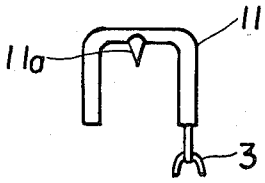
Figure 3A:
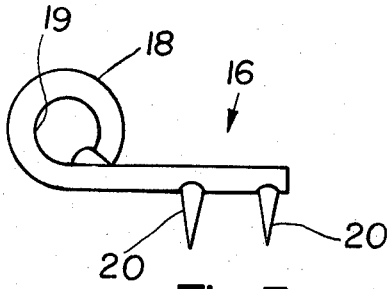
Figure 3:
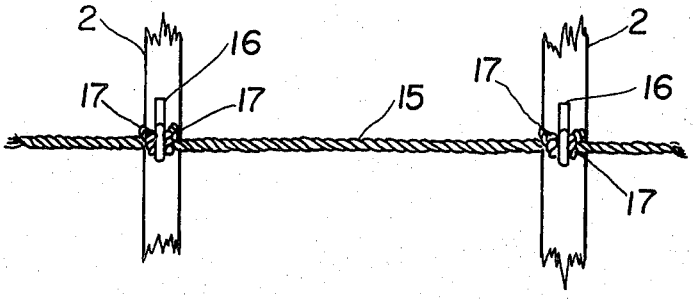

Other objects and advantages of the invention will become apparent from the following description, taken together with the accompanying drawing where:

FIG. 1 is a perspective view of a lifting support frame embodying my invention; and FIG. 2 is an enlarged, fragmentary perspective view of one of the connections shown in FIG. 1;

FIG. 2*a* is an enlarged plan view of the U-shaped part in FIG. 2;

FIG. 3*a* is an enlarged plan view of one of the spacing connections shown in FIG. 1 and FIG. 3 is a fragmentary assembly of the spacing connection shown in FIG. 1.

Referring more particularly to FIG. 1, numeral 1 denotes the framing of the side-walls of a building, such as a house, factory, etc. Numeral 2 denotes a roof truss having angular cores. A plurality of such trusses are shown except that one is shown in complete detail and the others are illustrated in phantom outline since they are of identical construction and are set in spaced, parallel vertical planes.

A plurality of lifting chains or cables 3, 3 of steel or other suitable metal are suspended from a lifting crane made of steel pipes or rods 4 and 5 which are in spaced parallel relationship and which are connected to steel pipes or rods 6 and 7 at substantially right angles thereto. There are two lifting cables 3, 3 for supporting the respective inclined top cores of each truss 2.

FIG. 2 shows the connection at each truss 2 comprising ½" round steel substantially U-shaped rod 11 which is welded to the end of a chain or cable 3. The tops of cable 3 are welded to the pipes 4 and 5. Four lifting cables 8 and connected together at 9 which is connected to a lifting hook of a crane (not shown). The extremities of cables 3 are each connected to the inverted U-shaped rod 11. U-shaped element 11 has an integral central tooth 11*a* which pierces the top center of truss 2 to assure uniform distance from the top apex of all trusses and thereby assure a perfectly horizontal base for all trusses.

To prevent the trusses from being blown together or apart by strong winds, links 15 of rope or flexible cable of equal length are detachably connected to the trusses by suspended eyes 16 having a pair of teeth 20 and an eye portion 18 having openings 19 through which rope 15 extends to interconnect the various trusses near the lower end portions at equal distances apart so as to insure that they will always be in spaced parallel relationship and thus simplify accurate placement of the trusses on top of the frame 1. Otherwise even mild winds would make accurate placement of the trusses very difficult. The respective links 15 may be formed from a continuous piece of rope having knots 17 at equally spaced intervals close to eyes 16.

The links 15 may be attached by hammering the hooks on top of the trusses so that the two sharp teeth will pierce the wooden frames of the trusses and keep them parallel. To remove the eyes, they may be easily hammered in the opposite direction to withdraw the teeth from the trusses.

While elements 4, 5, 6 and 7 have been illustrated as pipes, they may be made of angles or other cross sections instead. They may have a plurality of spaced holes to allow the trusses to be set on 24 inch (or perhaps 16 inch) centers.

Thus it will be seen that I have provided an efficient rig that can be suspended from the hook of any conventional crane and that can lift the entire assembly of roof trusses simultaneously and in proper spaced relationship to each other so as to greatly reduce the cost of assembling the trusses.

While I have illustrated and described a single embodiment of my invention, it will be understood that this is by way of illustration only and that various changes and modifications may be contemplated in my inventions and within the scope of the following claims.

I claim:

1. A rig for simultaneously setting a plurality of roof trusses on a building framing, comprising a pair of horizontally extending, spaced parallel beams adapted to extend over the respective central portions of the sloping sides of said trusses, a pair of cross beams at right angles to said beams and having ends connected to intermediate portions of said beams so as to provide overhanging extensions of said first mentioned pair of beams, a plurality of spaced vertical flexible linkage means suspended from each of the four overhanging extensions, and a plurality of spaced vertical flexible linkage means suspended from the intermediate remaining portions of said first mentioned pair of beams, and suspending means for support by the hook of a crane, said suspending means comprising four flexible linkage means extending from said hook and connected to end portions of each of said cross beams, a substantially U-shaped rod with parallel sides and an integral tooth projecting from the center of the U-shape parallel to the legs thereof, which rod is attached to the lower extremity of each of said vertical flexible linkage means to enable the lower end portions of the vertical flexible linkage means to wrap around the central portion of the sloping side of the respective truss and to be secured by inverting said U-shaped rod and snugly encircling it over the top of the central sloping side of the respective truss and piercing the top center with said tooth with said parallel sides closely fitting the sides of said truss, whereby the entire plurality of roof trusses may be easily and quickly lifted, lowered and moved horizontally to adjustably set them in place simultaneously on said building framing.

2. A rig as recited in claim 1 together with flexible means of equal length for tying together the lower extremity portions of said trusses to keep them in parallel relationship irrespective of heavy winds.

* * * * *